United States Patent [19]

Niebel

[11] Patent Number: 4,629,344

[45] Date of Patent: Dec. 16, 1986

[54] DOT MATRIX PRINT HEAD WITH AN ADJUSTABLE PRINT NEEDLE GUIDE

[75] Inventor: Harald Niebel, Senden, Fed. Rep. of Germany

[73] Assignee: Mannesmann Aktiengesselschaft, Duesseldorf, Fed. Rep. of Germany

[21] Appl. No.: 716,531

[22] Filed: Mar. 26, 1985

[30] Foreign Application Priority Data

Apr. 4, 1984 [DE] Fed. Rep. of Germany ..... 3412856

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,882,985 | 5/1975 | Liles | 400/124 |
| 4,400,101 | 8/1983 | Hendrischk | 400/124 |
| 4,459,051 | 7/1984 | Kawai | 400/124 |
| 4,541,745 | 9/1985 | Gugel | 400/124 |

FOREIGN PATENT DOCUMENTS

| | | | |
|---|---|---|---|
| 62165 | 5/1981 | Japan | 400/124 |

*Primary Examiner*—Paul T. Sewell

*Attorney, Agent, or Firm*—Ralf H. Siegemund

[57] ABSTRACT

A dot matrix print head which has on the side of the print countersupport (1) a print needle adjustment unit (3) with an electromagnetically drivable guide orifice (7) for the print needles (4) on an adjustment element (6). To provide a precise adjustment for the guide orifice (7) with controllable production tolerances, with flat design of the print head in the area of the guide orifice (7), and with easy installation, to provide a changeover for several guide orifices (7), and to define reliable end positions of the guide orifices (7), the adjustment element (6) consists of a guide support (7) mounted in the area of the print needle drive unit (2) and swiveling by means of a play-free joint (8). An electromagnet (15), fastened next to the guide support (7), is mounted on an armature bridge (13) supported in a play-free swivel bearing (14) running crossways to the guide support (7). The armature bridge (13) rests on the guide support (7) by spaced supporting projections (18), (19).

8 Claims, 4 Drawing Figures

DOT MATRIX PRINT HEAD WITH AN ADJUSTABLE PRINT NEEDLE GUIDE

FIELD OF THE INVENTION

The invention relates to a dot matrix print head with an adjustable print needle guide. A print needle drive unit is spaced away from a print countersupport, and a print needle adjustment unit is located between the print needle drive unit and the print countersupport. The print needle adjustment unit has an electromagnetically driveable guide orifice for the print needle fastened to an adjustment element.

BACKGROUND OF THE INVENTION

Adjustable guide orifices are used to adjust a dot matrix print head, not with its whole mass, but to the extent possible only with the mass of the guide orifice when the dot matrix print head is in the print position opposite a record carrier (e.g., an edge-punched paper, which is moved step-by-step or continuously). Adjustment of one or more print needle columns which, e.g., consist of 5 to 9 print needles placed above one another, is used to produced either calligraphy or high-speed printing. In the case of calligraphy, one or more of the print needle columns is adjustable in the direction of the print needle column.

It is known to form the adjustment element of such a dot matrix print head from a lever produced from an elastic material and mounted to swivel around an axis. Such apparatus is disclosed, for instance in published German patent applications DE-OS No. 30 41 877 and, respectively corresponding to U.S. patent application Ser. No. 317,130, filed Nov. 02, 1981 and U.S. Pat. No. 4,010,835 DE-OS 26 32 293, respectively corresponding to U.S. patent application Ser. No. 317,130, filed Nov. 02, 1981 and U.S. Pat. No. 4,010,835. Such an adjustment element requires, as has been shown, an accurate guide and a design that makes possible a better inspection of the printing process. Moreover, it is difficult with such a design to ensure economical production, which also includes an easy installation and a preparatory arrangement for changeover from one to two or more adjustable guide orifices.

A particular problem for known devices is presented by the end positions of the guide orifice, which must be kept very precise because of the printing exactness sought for calligraphy.

OBJECTS OF THE INVENTION

Therefore, the principle object of the invention is to provide a dot matrix print head in which it is possible to precisely adjust the guide orifice with easily controllable production tolerances.

It is a further object of the invention to provide such a dot matrix print head with a flat design in the area of the guide orifice.

It is yet a further object of the invention to provide such a dot matrix print head which is easy to install.

It is still a further object of the invention to provide such a dot matrix print head which has the capability of changeover from one to several guide orifices.

Finally, it is yet a further object of the invention to provide such a dot matrix print head which permits reliable adjustment of the end positions of the guide orifice.

SUMMARY OF THE INVENTION

The foregoing objects are achieved by an adjustment element consisting of at least one guide support mounted in the area of the print needle drive unit and swiveling by means of a play-free joint. An electromagnet, fastened next to the guide support, is attached to an armature bridge supported in a play-free swivel bearing running crossways to the guide support. The armature bridge rests on the guide support by spaced supporting projections. The play-free joint and the play-free swivel bearing assure an extremely precise adjustment of the guide orifice. The armature bridge allows a space saving arrangement of the electromagnet without requiring a high type of design in the guide orifice area. The breakdown into a guide support and an armature bridge assures easy installation and economical production of the dot matrix print head. Support of the armature bridge further assures adherence to the end positions with great precision.

In a preferred embodiment of this basic concept, the play-free joint consists of a leaf-spring which, on the one hand, is rigidly fastened to the body of the guide support and, on the other hand, is fastened to the print head housing in the area of the print needle drive unit. In addition to the freedom from play, it is advantageous for the body of the guide support itself to be rigid and not to form any spring.

Making the play-free swivel bearing for the armature bridge from a knife-edge bearing also contributes to the precise adjustment of the guide support. With such a knife-edge bearing, the advantage of slight friction can be utilized.

In production engineering, it is advantageous that the knife-edge bearing be formed from a round rod mounted in the print head housing and from a corresponding depression in the armature bridge. This design assures an economical production of the parts with favorable tolerance selection.

Installation is additionally facilitated in that the round rod of the knife-edge bearing is fastened in a removeable cover of the print head housing.

The system described above allows more than one guide support to be provided in parallel arrangement without great expenditure.

For precise adherence to the middle position in a multiple adjustment element system, it is further advantageous if the armature bridge is upheld by arms of a holder running symmetrically to the knife-edge bearing.

Adherence to the adjustment of the guide orifice or orifices for the print needle column or columns to be made between printing passes in this connection can be especially advantageously designed by the support projects on the armature bridge being provided in an established distance ratio to the knife-edge bearing. This concept takes in a broad range of applications of the individual adjustment stages, whereby it becomes possible to achieve different adjustment distances for high-speed printing and calligraphy merely by exchange of the armature bridge. A selection of different armature bridges can therefore represent a broad range of different character fonts and qualities.

A space saving arrangement (i.e., a flat design) is also obtainable in the case of more than one guide support by the electromagnets being placed to the side of the guide support in the case of two guide supports running parallel.

An additional adjustment possibility is further obtained by the electromagnet being adjustable from the outside of the dot matrix print head housing in relation to the air gap.

DETAILED DESCRIPTION OF THE PRESENTLY PREFERRED EMBODIMENTS

Figure 2:
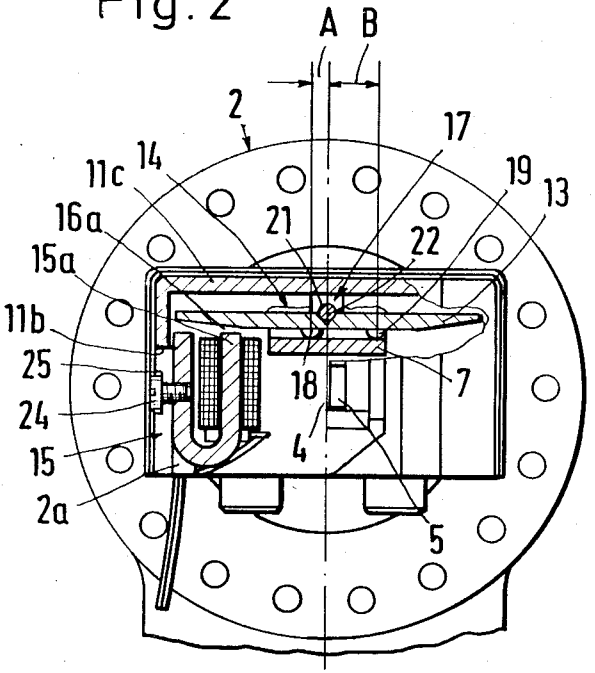
FIG. 2 is a cross section through the embodiment of FIG. 1 taken on the line II—II in FIG. 1.

A dot matrix print head with an adjustable print needle guide is opposite a print countersupport 1 during operation of the dot matrix printer. The print countersupport 1 generally consists of a cylindrical platen. A print needle drive unit 2 is on the side of the dot matrix print head away from the print countersupport i.e. a printing platen 1. The design of the print needle drive unit 2 is independent of the print needle adjustment unit 3. Therefore, the design of the print needle drive unit 2 is not described here. It is important only that the print needle drive unit be equipped with at least one column consisting of a plurality of print needles 4.

Figure 1:
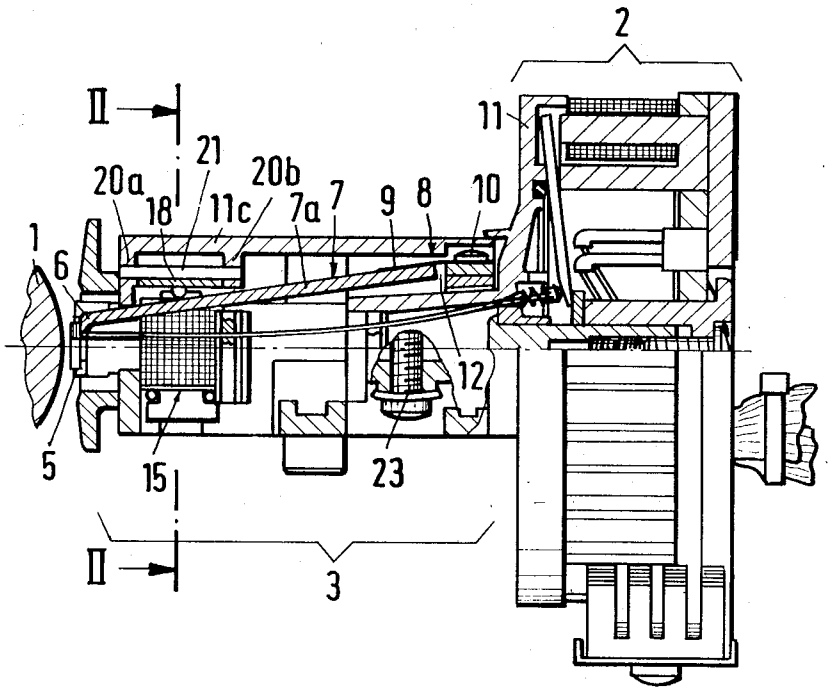
FIG. 1 is an axial partial longitudinal section through a first embodiment of the invention in which a dot matrix print head has a single guide support.

Print needle adjustment 3 has a guide orifice 5 that is electromagnetically driveable and vertically adjustable up and down. The guide orifice 5 is fastened to an adjustment element 6. The adjustment element 6 is formed from guide support 7 (a rigid rod) and a rear play-free joint 8. The joint 8 is play-free because it consists of a leaf spring 9 which is connected to the body 7*a* of the guide support 7 (e.g., by spot welding) and is rigidly fastened to a bearing 11*a* of a print head housing 11 by a screw 10. The leaf spring 9 spans a gap 12 between the body 7*a* and the bearing ll*a*. The gap 12 is functionally part of the play-free joint 8. The guide support 7 is thus pivotable about an axis that extends transverse to the plane of the drawing of FIG. 1 (or FIG. 3), which is also transverse to the direction of extension of the needles 1 and of support 7.

The control element for the adjustment element is an armature bridge 13 which rests in a swivel bearing 14 that is also play-free. Bridge 13 swivels about an axis that extends transverse to the plane of the drawing of FIG. 2 (or 4). An electromagnet 15 is placed below and to the side of the armature bridge 13 (see both FIG. 2 and FIG. 4). The armature bridge 13 projects over magnet core 15*a*. An air gap 16*a* is present between the armature bridge 13 and the magnet core 15*a* when the electromagnet 15 is not activated. When current is applied to the electromagnet 15, the armature bridge 13 swivels around a knife-edge bearing 17, and projections 18 or 19 on armature bridge 13 press guide support 7 downwardly.

Figure 4:
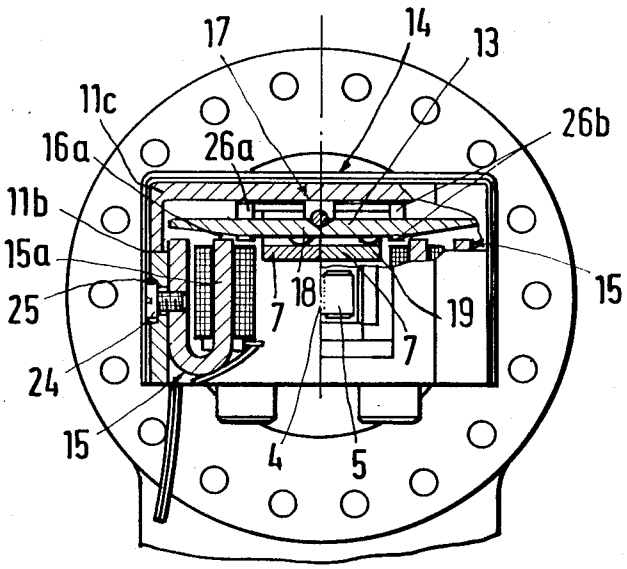
FIG. 4 is a cross section through the embodiment of FIG. 3 taken on the line III—III of FIG. 3.

The knife-edge bearing 17 can be embodied in several designs, but in each case play must be avoided. A play-free swivel bearing 14 consisting of a play-free knife-edge bearing 17 is formed by a round rod 21. The round rod 21 is fixed in bearing heads 20*a* and 20*b* in print head housing 11 or in a cover 11*c* mounted on the print head housing 11. As shown in FIGS. 2 and 4, the round rod 21 is received in a corresponding depression 22 in the armature bridge 13. The play-free swivel bearing 14 or the play-free knife-edge bearing 17 is obtained during installation of the cover ll*c* by tightening of a screw 23. As a result of the tightening of the screw 23, the cover 11*c* occupies a fixed position on a rim surface 11*b* of the print head housing 11.

After the installation of the cover 11*c*, the armature bridge 13 having the depression 22 and the round rod 21 bears against the guide support 7 through the projections 18 and 19. The guide support 7, in turn, is play-free in one of two end positions. The first, or unactuated end position is shown in the drawings. The second end position is obtainable by actuation of the electromagnet 15.

It should be noted that the width of the air gap 16*a* is additionally adjustable. The second adjustment possibility is produced by the adjustable mounting of the electromagnet 15, which is fastened on the outside section of the U-shaped magnet core 15*a* by a set screw 24. The set screw 24 is provided in a longitudinal slot 25, so that the electromagnet 15 can be adjusted from partially open side 2*a* of print needle drive unit 2.

Figure 3:
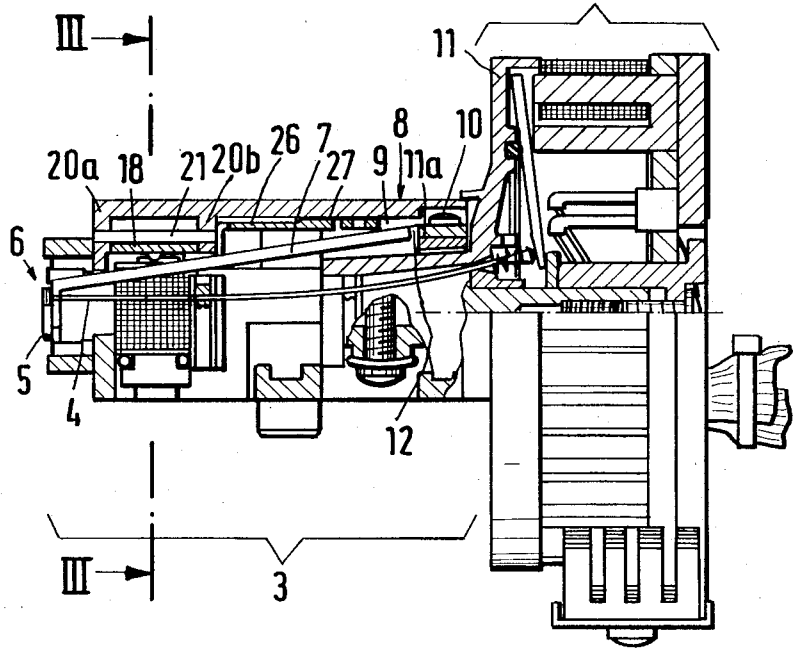
FIG. 3 is an axial partial longitudinal section through a second embodiment of the invention in which a dot matrix print head has two guide supports.

In the embodiment shown in FIGS. 3 and 4, two guide support 7 are provided. The two guide support 7 are separated by a gap and run parallel to one another. The armature bridge 13 is held up by arms 26*a* and 26*b* of a holder 26. The holder 26 in turn is fastened on the inside of the cover 11*c* by a leaf spring 27.

In both embodiments, the projections 18, 19 on the armature bridge 13 are in an established distance ratio A:B (as shown in FIG. 2), which in the illustrated embodiment is 1:3. However, for interchangeable armature bridges 13 it can take any value that is appropriate for high-speed printing or calligraphy, so that armature bridges with different distances between the knife-edge bearing and the projections 18 and 19 can be stocked.

The electromagnets 15 for two guide supports 7 (i.e., the embodiment shown in FIGS. 3 and 4) are placed on the side in each case next to guide support 7 (see especially FIG. 4), and the effective axis of each electromagnet 15 is vertical.

What is claimed as new and desired to be secured by Letters Patent of the United States is:

1. A dot matrix print head having a housing;

a print needle drive unit mounted in said housing;

a plurality of print needles operatively connected to said print needle drive unit and extending therefrom in a first direction which, during printing, is a movement toward a print platen, the improvement of providing an adjustable front end support for the needles comprising:

a guide support extending generally in said first direction, one end of said guide support being pivotally mounted in said housing by means of a play-free joint for pivoting on an axis transverse to said direction an opposite end of said guide support carrying a guide orifice for front ends of said plurality of print needles;

an electromagnet mounted in said housing to one side of said guide support and said plurality of print needles; and an armature bridge supported in said housing in a play-free swivel bearing extending crossways to said guide support, said armature bridge having two spaced projections, one on either side of said play-free swivel bearing, bearing against said guide support, said armature bridge as pivotally movable about said play-free swivel bearing, for pivoting on an axis in said first direction and being movable therewith between a first and a second position in response to actuation of said electromagnet, the pivotal movement of said armature bridge causing corresponding pivotal movement of said guide support about play-free joint between a first and a second position.

2. A dot matrix print head as in claim 1 wherein said play-free joint comprises a leaf spring one end of which being rigidly fastened to said guide support and another end being rigidly fastened to said housing adjacent to said print needle drive unit.

3. A dot matrix print head as in claim 1 wherein said play-free swivel bearing is a knife-edge like bearing.

4. A dot matrix print head as in claim 3 wherein said knife-edge bearing comprises:

(a) a round rod mounted in said housing and (b) a depression in said armature body sized, shaped, and positioned to received said round rod.

5. A dot matrix print head as in claim 4 wherein said round rod is mounted in a portion of said housing which is detachable from the remainder of said housing.

6. A dot matrix print head as in claim 1 wherein a plurality of guide supports are provided in parallel arrangement.

7. A dot matrix print head as in claim 1 wherein said armature bridge is mounted in a holder which is symmetrical with respect to said play-free swivel bearing.

8. A dot matrix print head as in claim 1 wherein the position of said electromagnet in said housing is adjustable from outside said housing.

* * * * *